United States Patent [19]

Andersson et al.

[11] 4,150,383

[45] Apr. 17, 1979

[54] MONOPULSE FLAT PLATE ANTENNA

[75] Inventors: Karl A. K. Andersson, Mölnycke; Lars G. Josefsson, Askim; Lars F. Moeschlin, Västra Frölunda, all of Sweden

[73] Assignee: Telefonaktiebolaget L M Ericsson, Stockholm, Sweden

[21] Appl. No.: 775,430

[22] Filed: Mar. 8, 1977

[30] Foreign Application Priority Data

Mar. 22, 1976 [SE] Sweden ..... 7603420

[51] Int. Cl.[2] ..... H01Q 13/10; H01Q 3/26

[52] U.S. Cl. ..... 343/771; 343/768; 343/854

[58] Field of Search ..... 343/725, 768, 771, 854

[56] References Cited

U.S. PATENT DOCUMENTS

| | | | |
|---|---|---|---|
| 3,482,248 | 12/1969 | Jones | 343/771 |
| 3,653,052 | 3/1972 | Campbell et al. | 343/771 |
| 3,701,158 | 10/1972 | Johnson | 343/725 |
| 3,943,523 | 3/1976 | Fassett | 343/854 |

FOREIGN PATENT DOCUMENTS

| | | | |
|---|---|---|---|
| 2603609 | 8/1976 | Fed. Rep. of Germany | 343/771 |

*Primary Examiner*—Alfred E. Smith
*Assistant Examiner*—Harry E. Barlow
*Attorney, Agent, or Firm*—Hane, Roberts, Spiecens & Cohen

[57] ABSTRACT

An antenna includes a disk of dielectric material with a number of radiator elements and signal processing circuits. The radiator elements are arranged mirror-symmetrically with respect to two perpendicular axis and are divided into a number of sectors. When the antenna is a receiver a first part of the signal processing circuits is arranged in a first layer of the disk for combining signals emitted by the elements of any sector while a A second part of the signal processing circuits is arranged in a second layer of the disk for combining signals coming from sectors similarly located with respect to the axes to groups of signals, each group of signals having at least one signal of generated sum signals and difference signals with respect to the two axes. A third and last part of the signal processing circuits is arranged in a third layer of the disk for combining in the groups of signals included sum signals and difference signals and for emitting the combined signals to the output terminals of the antenna.

5 Claims, 4 Drawing Figures

MONOPULSE FLAT PLATE ANTENNA

BACKGROUND OF THE INVENTION

The present invention refers to an antenna which is designed in such a way that it has a disk of a dielectric material with a number of receiver elements for receiving external incoming signals or internal outgoing signals as well as signal processing circuits for treatment of either the internal or external signals for the receiver elements. In principle the antenna can thus be used as a receiver antenna or as a transmitting antenna, but, in order to be simple the following specification; it will be limited to an antenna working as a receiver antenna.

SUMMARY OF THE INVENTION

An object of the invention is to provide an antenna which, in proportion to its size, shows a directional pattern with extremely low side lobe levels. In general the side lobe level is of great importance for the performance of an aircraft radar system at low flying heights and when there are snow, rain, background disturbances and multiple targets. With an antenna according to the invention it is possible, compared with antennas of a conventional type, to obtain such an average side lobe level that a considerable reduction of the flying height can be permitted.

The characteristics of the antenna according to the invention appear from the appended claims.

BRIEF DESCRIPTION OF THE DRAWING

The invention will be described more in detail in connection to the appended drawings where.

DESCRIPTION OF PREFERRED EMBODIMENTS

The disk antenna 10 according to the invention comprises three disks 10, 10' and 10''.

Figure 1:
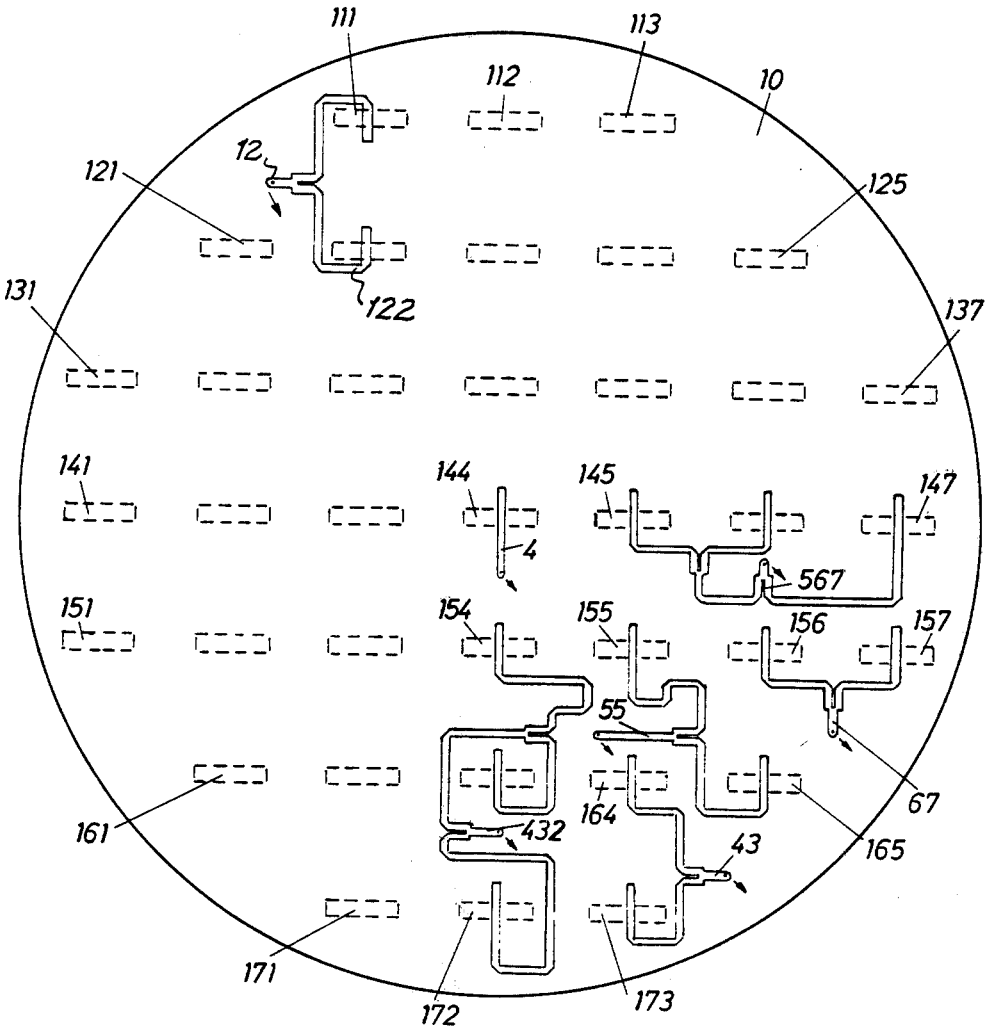
FIG. 1 shows a slit layer of a disk antenna.

In FIG. 1 the top part of a disk 10 of a dielectric material is shown. The disk 10 has three layers. In the top layer, the element layer or the slit layer, several radiator or elements are arranged. They are schematically drawn as dashed rectangles. The radiator elements are arranged in seven rows disposed symmetrically with respect to two orthogonal axes or diameters through the center of the disk 10. The first and the seventh row have three elements each, that is the elements 111, 112, 113 and the elements 171, 172, 173. The second and the sixth row have five elements each, that is the elements 121–125 and the elements 161–165. The third, fourth and fifth rows have seven elements each, that is the elements 131–137, the elements 141–147 and the elements 151–157 in the respective row. The element in the middle of each row is placed on the vertical symmetry axis and the fourth row of elements is placed on the horizontal symmetry axis as viewed in FIG. 1. Generally all the radiator elements are placed symmetrically with respect to these orthogonal axes. However, hereinafter radiator elements which are not placed on the symmetry axes will be dealt with first. The radiator elements of the symmetry axes of each quadrant are allocated to a number of sectors. There are three sectors in the shown embodiment. Consequently, in the fourth quadrant the elements 155 and 165 constitute a first sector, the elements 156 and 157 a second sector and the elements 164 and 173 a third sector. In the same way the radiator elements of the remaining three quadrants form three sectors of elements in each quadrant so that such sectors are image symmetrically placed in correspondence with the orthogonal or symmetry axes. Besides the above-mentioned sectors there are still five sectors, that is one sector in each half of the symmetry axes comprising three radiator elements and one sector in the center of the element layer comprising only one radiator element. In FIG. 1 a sector with three elements 145–147 has been marked on the right half of the horizontal symmetry axis and a sector with three elements 154, 163, 172 has been marked on the lower half of the vertical symmetry axis. Consequently the element layer comprises totally 37 receiver elements divided into 17 sectors. Each receiver element consists of a symmetrical slit.

Special circuits are arranged for the processing of the signals received from the outside by the radiator elements and a first part of these circuits is arranged to sum the signals being emitted by the radiator elements in one and the same sector of any of the sectors. In FIG. 1 it is shown schematically how the elements 155 and 165 of the first sector are connected together by circuit 55. In the same way the elements 156 and 157 of the second sector are connected together by circuit 67 and the elements 164 and 173 of the third sector are connected by circuit 43. The three remaining quadrants are provided with corresponding circuits connected together for the symmetrically arranged sectors. In addition, the sectors on the symmetry axes and in the center of the element layer are similarly connected by the respective circuits 567, 432 and 4. There are corresponding circuits connected together for the sectors on the two remaining half axes, however, they are not shown in FIG. 1.

It is appropriate to design this element layer or disk 10 as a multi-layer structure consisting of a ground layer I—a dielectric layer I—and a dielectric layer II——a ground layer II. Then the ground layer I constitutes the outer limiting surface of the radiator elements and the interconnected circuits are arranged on the surface of the dielectric layer II which surface is faces the surface of the dielectric layer I. As an alternative the interconnected can be arranged on the surface of the dielectric layer I which faces the surface of the dielectric layer II. In FIG. 1 arrows pointing obliquely downwards are shown for the circuits connected together. These arrows show inlets to an underlaying comparator layer or disk 10' shown in FIG. 2.

A second part of the signal processing circuits is arranged to sum signals from sectors similarly placed with reference to the orthogonal axes in the element layer to groups of signals. Then each group of signals consists of at least one signal of sum- and difference signal formed with reference to the two orthogonal axes.

Figure 2:
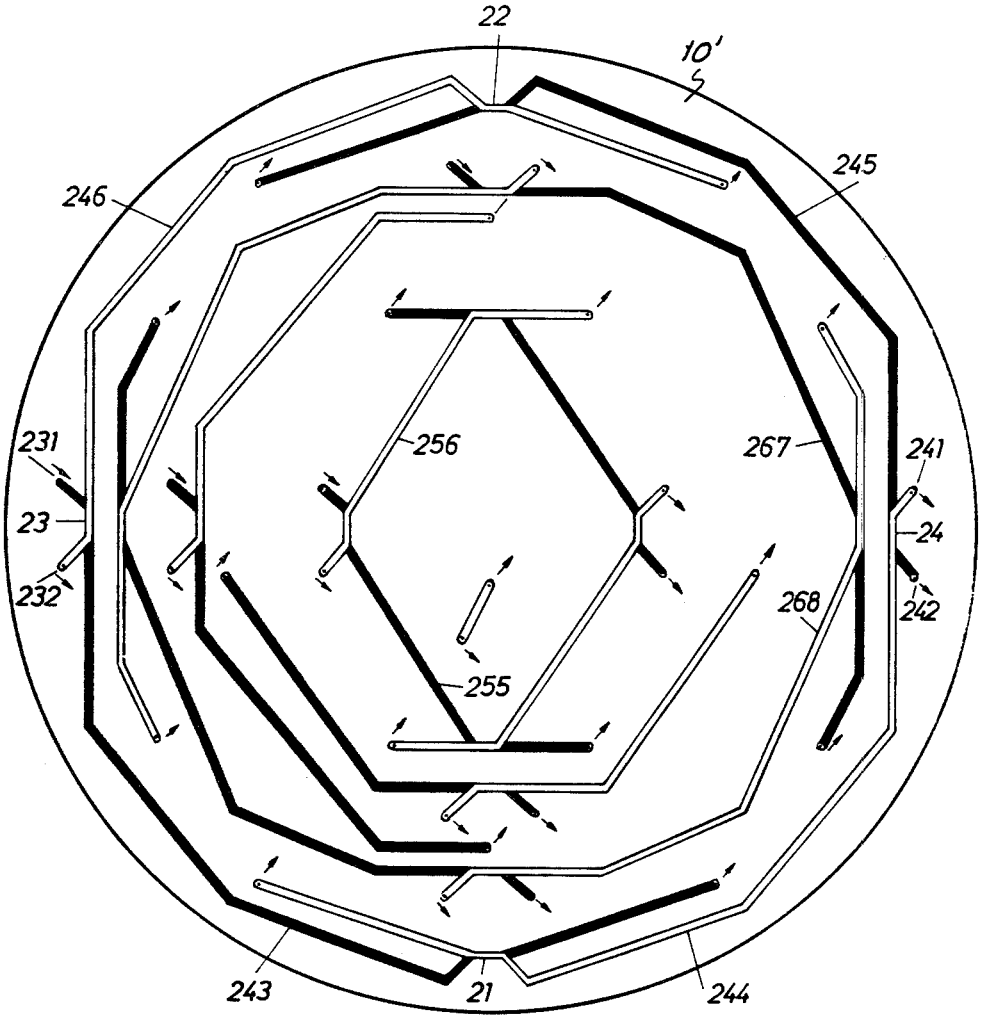
FIG. 2 is a comparator layer of the antenna FIG. 3 an adding layer according to the invention and FIG. 4 is a schematic diagram showing the interconnection of the radiating elements and the signal processing circuitry.

In FIG. 2 the comparator layer or disk 10' is shown schematically where a sum signal ($\Sigma$) and difference signals ($\Delta_h$ and $\Delta_s$) are formed. Also a fourth so; called $\Delta_\Delta$-signal is formed but is not used in the described embodiment. Connection circuits for all the quadrants of the antenna are drawn as "circles" or as part of "circles"inlet to the overlying element layer (FIG. 1) are shown by means of arrows pointing obliquely upwards and the inlet to an underlying adding layer of dish 10' (FIG. 3) are shown by means of arrows pointing obliquely downwards. The circuit elements 243, 244, 245 and 246 are parts of an outer circle. The right end of the element 243 is then connected to the circuit 43 of FIG. 1 by means of an inlet to the element layer. The left end of the element 244 is connected to the circuit which is mirror symmetric in the third quadrant. The left end of the element 245 is connected to a sector circuit in the second quadrant by means of an inlet to the element layer and the right end of the element 246 is connected to the sector circuit which is mirror symmetric in the first quadrant. The circuit elements 245 and 246 are connected together by means of a directional coupler 22. The circuit elements 243 and 246 are connected together by means of a directional coupler 23 which is designed in such a way that a $\Delta_h$-signal is obtained at the upper terminal 231 of such directional coupler and at the lower terminal 232 of the directional coupler an $\Sigma$ -signal is obtained.

The circuit elements 244 and 245 are connected together by means of a directional coupler 24 which is designed in such a way that a $\Delta_\Delta$-signal is obtained at the upper terminal 241 of the coupler and a $\Delta_s$-signal is obtained at the lower terminal 242 thereof.

By analogy with what has been stated concerning the outer circle it is seen in FIG. 2 that there is towards the center, a circle of circuit elements, a half circle of circuit elements in the second and third quadrants, a half circle of circuit elements in the third and fourth quadrants as well as an inner circle of circle elements. Interconnections by means of directional couplers provide part signals which proceed through inlets (see arrows pointing downwards) to the adding or summing layer of FIG. 3. When forming the signals necessary phase differences can be obtained by using conveniently adjusted lengths of cable.

It is appropriate to design the comparator layer or dish 10' as a multi-layer consisting of a ground I — a dielectric layer I——a dielectric layer II - a dielectric layer III - and a ground layer II. Circuit elements, for example 243 and 244, are placed on opposite sides of the dielectric layer II. In fact, all heavy dark lines indicate circuit elements on one side of layer II and all open lines indicated circuit elements on the other side. The circuit elements 243 and 244 constitute a directional coup;er of a so called "coupled transmission line coupler"-type. (See for example Ericsson Technics number 3/75 page 146) and mutually overlap exactly at the coupling spot.

Figure 3:
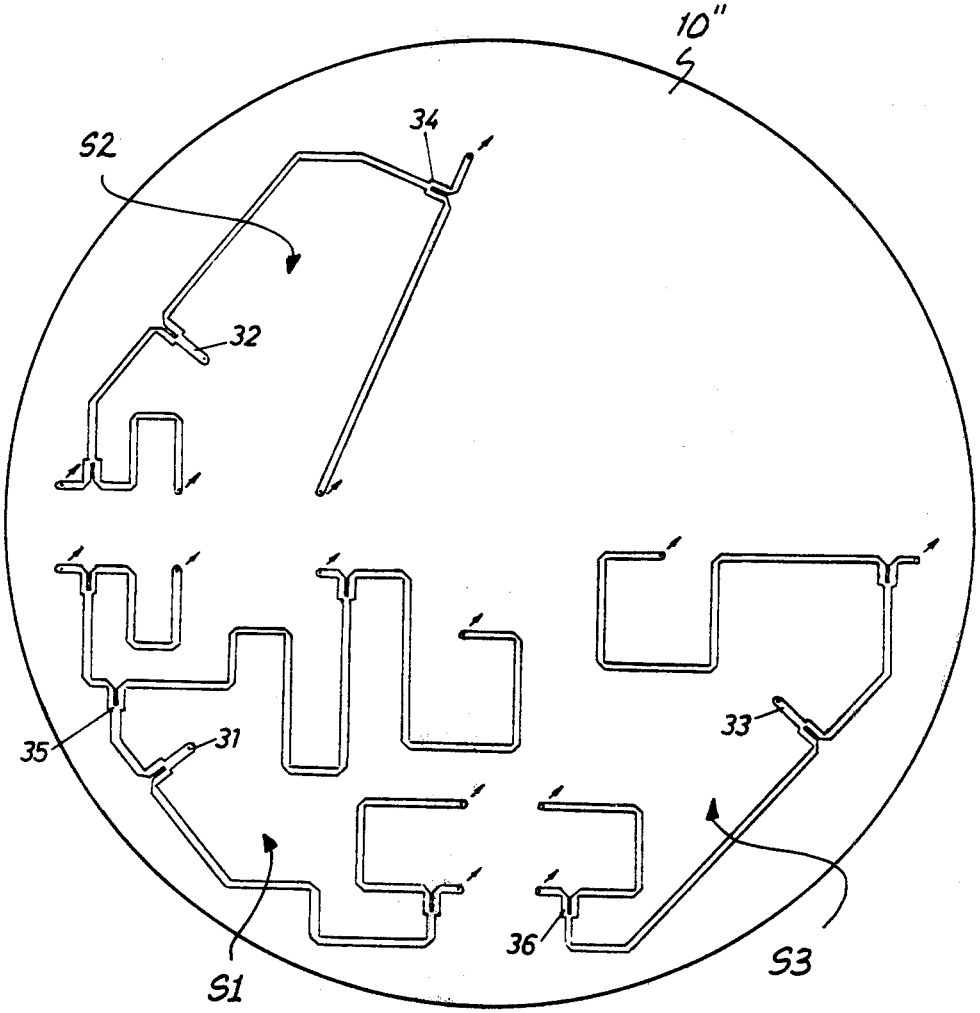

In FIG. 3 the adding layer of dish 10'' is schematically shown where the adding or summing of the three types of signals from the comparator layer is effectuated. FIG. 3 shows that the signals are added in three parts, that is one in the second quadrant which adds the $\Delta_h$-signals via among others a circuit 34, one in the third quadrant which adds the $\Sigma$ — signals via among others a circuit 35 and one in the fourth quadrant which adds the $\Delta_s$-signals via among others a circuit 36. Arrows pointing upwards show the connections to the overlying comparator layer of FIG. 2. The output terminals of the antenna are connected to the points 31, 32 and 33.

Figure 4:
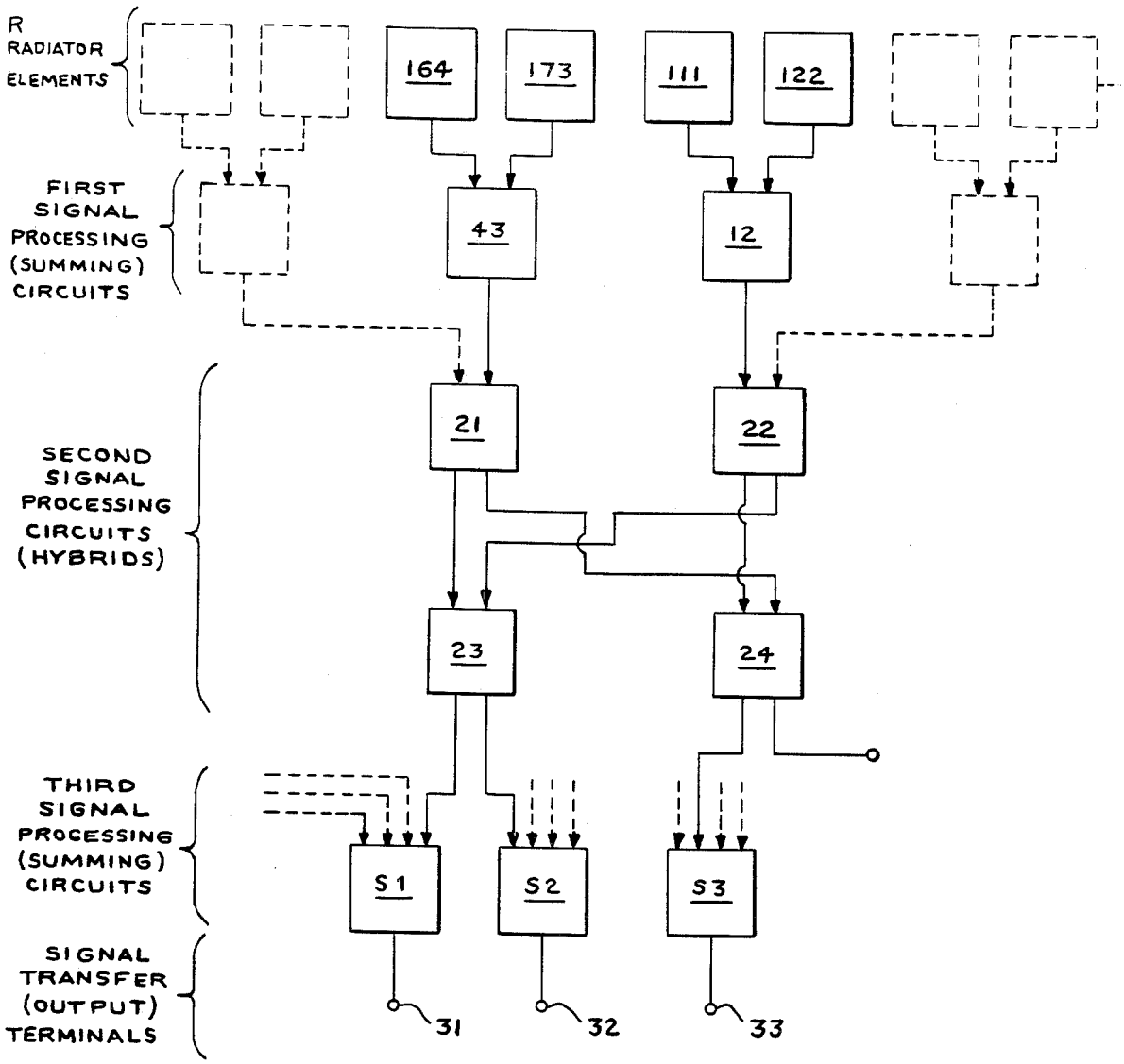

In FIG. 4 a schematic diagram of the antenna is shown using the same reference characters as used in FIGS. 1 to 3. Since many of the circuits are redundant only a sufficient number are shown to convey the fundamental concepts. In particular, the radiator elements 164 and 173 of one particular sector are connected to a summing circuit 43. The output of circuit 43 is connected to one input of hybrid 21 which receives the output of a corresponding summing circuit associated with the sector from another quadrant at another of its inputs. The outputs of hybrids 21 and 22 are connected to another group of hybrids including hybrids 23 and 24 for further processing. The outputs of these hybrids are fed to second summing circuits S1, S2 and S3, whose outputs are connected to transfer terminals 31,32 and 33 to produce the usual sum and two-difference signals associated with a monopulse radar antenna.

The above-described embodiment of an antenna refers to a receiver antenna but as has been stated in the introduction the antenna can very well be utilized also as a transmitting antenna. Hence, the term radiator element has been used. It is then important, however, to observe that the signal processing circuits are adapted for transmission in both directions and that the above mentioned terminals designated as output terminals will instead be the input terminals of the antenna. In such case the output terminals are generically called "transfer terminal."

We claim:

1. A disk shaped antenna comprising a number of receiver elements (111 . . . 173) to externally receive incoming signals and signal processing circuits (for example 55, 21, 35) to process signals received by the receiver elements, characterized in: that the receiver elements are arranged symmetrically with reference to two orthogonal axes and divided into a number of sectors for each of the four quadrants defined by the axes; that a first set of the signal processing circuits (for instance 55, 67, 43) is arranged within each sector for combining signals from the receiver elements of the sector; that a second set (for instance 21, 22, 23, 24) of the signal processing circuits is arranged to combine signals from sectors that are symmetrically placed with reference to the orthogonal axes into groups of signals, each group of signals consisting of one sum-signal and/or at least one difference signal with reference to the two orthogonal axes; and that the remaining part (for instance 35) of the signal processing circuits is arranged to combine sum signals and difference signals included in said groups of signals and to transfer signals originating from the processing circuits to the outputs.

2. A disk shaped antenna according to claim 1 characterized in that there are three layers, one of said layers being an element layer in which all receiver elements are arranged as well as said first part of the signal processing circuits, another of said layers being a comparator layer in which said second set of the signal processing circuits is arranged, and a third of said layers being a combiner layer in which the remaining part of the signal processing circuits is arranged as well as the outputs of the antenna.

3. An antenna comprising: a disk structure, said disk structure having two orthogonal axes which divide the disk structure into four quadrants; a plurality of radiator elements on said disk structure adjacent one surface thereof, said radiator elements being arranged symmetrically with respect to the two orthogonal axes and divided into plurality of like sectors within each quadrant to form symmetrical sets of sectors; a plurality of first signal processing means in said disk structure, each of said first signal processing means being connected to all radiator elements in a sector; a plurality of second signal processing circuits, each of said second signal processing circuits being a hybrid means for producing sum and/or difference signals for each symmetrical set of sectors, said second signal processing circuits being connected to the first signal processing circuits associated with all the sectors of each symmetrical set; and third signal processing circuits in said disk structure, each of said third signal processing circuits having a set of first signal transfer terminals, and a second signal transfer terminal connected to all of said first signal transfer terminals, said first signal transfer terminals being connected to selected ones of said hybrid means, and said second signal transfer terminals being adapted to be connected to signal devices external to the antenna.

4. The antenna of claim 1 wherein said first and third signal processing circuits are signal summing circuits and said second signal transfer terminals are connected to a signal receiver whereby the antenna is a receiving antenna.

5. The antenna of claim 3 wherein said first and third signal processing circuits are signal power dividing circuits and said second signal transfer terminals are connected to a signal transmitter whereby the antenna is a transmitting antenna.

* * * * *